US006755143B2

(12) United States Patent
Mermier et al.

(10) Patent No.: US 6,755,143 B2
(45) Date of Patent: Jun. 29, 2004

(54) WIDE CRUISE SHIP OR PLEASURE BOAT

(75) Inventors: Laurent Mermier, 32, rue Galilée, 44100 Nantes (FR); Joel Bretecher, 1 allée des Etangs - La Joalliére, 44800 Sautron (FR)

(73) Assignees: Laurent Mermier, Nantes (FR); Joel Bretecher, Sautron (FR); Chantiers de l'Atlantique, Paris (FR)

( * ) Notice: Subject to any disclaimer, the term of this patent is extended or adjusted under 35 U.S.C. 154(b) by 0 days.

(21) Appl. No.: 10/268,684

(22) Filed: Oct. 11, 2002

(65) Prior Publication Data

US 2003/0075092 A1 Apr. 24, 2003

(30) Foreign Application Priority Data

Oct. 23, 2001 (FR) ..... 01 13652

(51) Int. Cl.[7] ..... B63B 3/00
(52) U.S. Cl. ..... 114/65 R
(58) Field of Search ..... 114/65 R, 45, 114/264, 66, 382

(56) References Cited

U.S. PATENT DOCUMENTS 1,038,176 A * 9/1912 Millican ..... 114/65 R
1,088,239 A * 2/1914 Paine ..... 114/65 R
2,076,957 A * 4/1937 Lueck ..... 114/65 R

FOREIGN PATENT DOCUMENTS

| | | | |
|---|---|---|---|
| DE | 32 37 827 | A1 | 4/1983 |
| EP | 0 037 843 | A1 | 10/1981 |
| EP | 0 790 179 | A1 | 8/1997 |
| FR | 2 478 017 | A | 9/1981 |
| GB | 1 297 245 | A | 11/1972 |
| GB | 2 083 415 | A | 3/1982 |
| GB | 2 103 550 | A | 2/1983 |
| JP | 52-125582 | A | 10/1977 |
| JP | 54-59778 | | 5/1979 |
| JP | 54-59779 | A | 5/1979 |
| JP | 55-63992 | A | 5/1980 |
| JP | 61-207292 | A | 9/1986 |
| JP | 61-211192 | A | 9/1986 |
| JP | 2-164687 | A | 6/1990 |
| JP | 8-254346 | A | 10/1996 |
| JP | 11-334697 | A | 12/1999 |
| JP | 2001-301686 | A | 10/2001 |

* cited by examiner

*Primary Examiner*—Jesus D. Sotelo
(74) *Attorney, Agent, or Firm*—Sughrue Mion, PLLC

(57) ABSTRACT

A cruise ship or pleasure boat has classically proportioned quickwork and a main public space bordered by port and starboard longitudinal superstructures which have an overall transverse inclination which makes the main public space sunnier and substantially increases the width of the ship above the waterline.

6 Claims, 1 Drawing Sheet

WIDE CRUISE SHIP OR PLEASURE BOAT

BACKGROUND OF THE INVENTION

1. Field of the Invention

The present invention concerns a wide cruise ship or pleasure boat. The ship has an open or semi-open central public space bordered by longitudinal superstructures. Here the expression "public space" means a space comprising one or more areas dedicated primarily to the use of passengers.

2. Description of the Prior Art

Pleasure boats are conventionally single-hull vessels with decks whose width is identical or similar to the width of the ship at the waterline. The outdoor public spaces are generally on the upper deck. Some innovative ship designs have been developed to meet an ever increasing demand to increase the number of cabins and other areas giving onto the outside. Thus some ship designs provide a large longitudinal main public space situated on a lower deck and bordered by port and starboard vertical longitudinal superstructures accommodating cabins and other areas. These ship designs have a width that is too small to obtain a sufficient distance between the longitudinal superstructures; the approximately U-shaped cross section of these ship designs does not produce a volume of air above the main public space that is sufficiently wide for the public space and the cabins and other areas giving onto the public space to be user-friendly, pleasant and sufficiently sunny. Widening the entire ship is not viable, primarily for reasons of uncomfortable rolling and additional construction and operating costs.

SUMMARY OF THE INVENTION

The type of ship according to this invention meets the demand for many outside and user-friendly spaces whilst also satisfying comfort and safety demands. It has a large main public space situated on a lower deck and bordered by port and starboard longitudinal superstructures. The quickwork of the ship is classically proportioned, meeting comfort, stability and drag requirements. The cross section of the ship is approximately V-shaped, the longitudinal superstructures having an overall transverse inclination. This overall inclination makes the main public space situated at the base of the longitudinal superstructures more sunny and creates an impression of stadium terraces. In the event of invasion by water, the overall shape of the ship increases the width at the waterline as the ship settles and thereby significantly improves stability of the ship, which depends directly on the transverse inertia at the waterline. Moreover, by moving the masses away from the longitudinal axis, this overall shape increases the roll period of the ship and thus improves passenger comfort.

The accompanying drawings illustrate the invention.

DETAILED DESCRIPTION OF THE PREFERRED EMBODIMENTS

Figure 1:
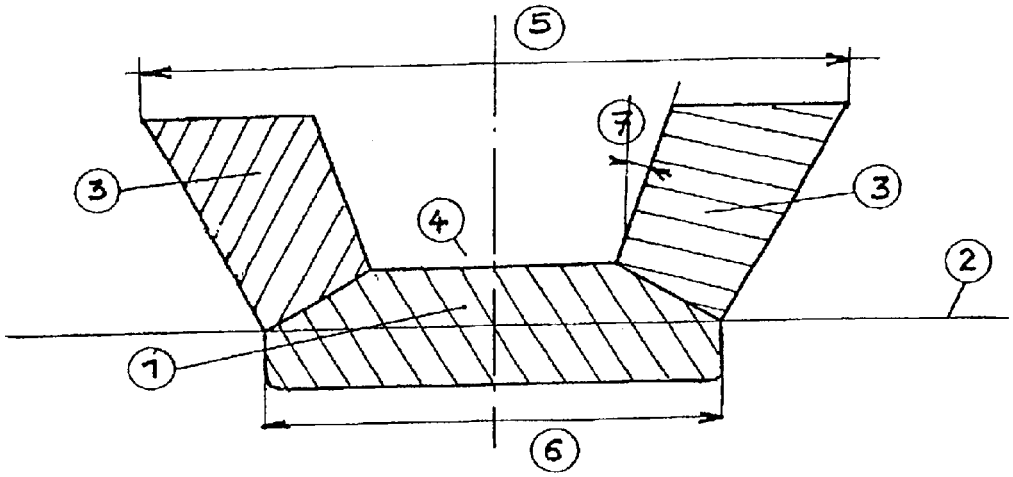
FIG. 1 shows the principle of the invention in cross section.
Figure 2:
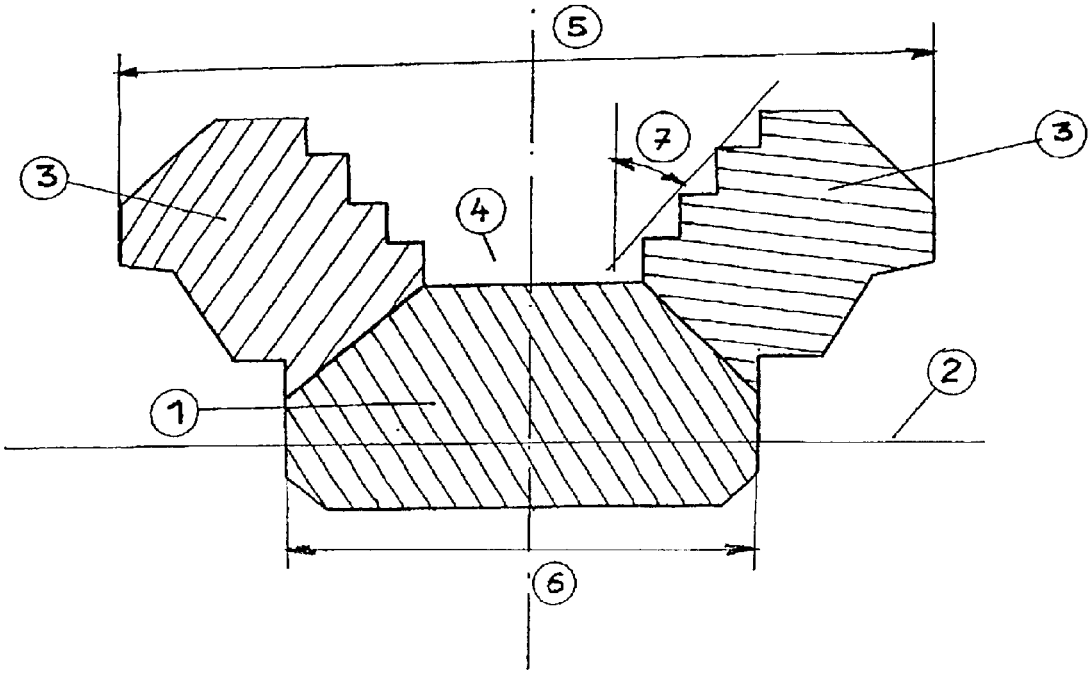
FIG. 2 shows a variant of the principle in cross section.

Referring to the drawings, the ship has a main structure 1 whose portion below the waterline 2 constitutes the quickwork. The quickwork is classically proportioned, meeting comfort, stability and drag requirements. A large open or semi-open main public space 4 is situated on the main structure 1. The ship has longitudinal port and starboard superstructures 3 with an overall transverse inclination. This inclination must make the lower main public space 4 more sunny and substantially increase the total width of the ship above the waterline. The ratio of the width 5 of the ship to the width 6 at the waterline can vary from 1.3 to 3 and the mean rake angle of the inboard facade 7 can vary from 15° to 60°.

The ship can be built using the materials and equipment routinely used in the building of cruise ships.

By way of non-limiting example, the ship can have a width at the waterline of 32 meters and an overall width of 58 meters, with an overall length of 250 meters. The longitudinal superstructures and the main public space can extend over the aft three-quarters of the ship, the forward quarter consisting of a full-width enclosed area dedicated to public spaces and to the wheelhouse. The aft portion of this enclosed area, which links the port and starboard longitudinal superstructures, can be made up of terraces which give the overall impression of an amphitheater. The stern of the ship can form a marina.

The ship according to the invention is particularly intended for cruising.

There is claimed:

1. A cruise ship or pleasure boat having classically proportioned quickwork and a main public space bordered by port and starboard longitudinal superstructures which are immovable with respect to the ship and which have an overall transverse inclination which makes said main public space sunnier and substantially increases the width of the ship above the waterline.

2. The ship claimed in claim 1, wherein the ratio of the width of said ship to the width of said waterline is from 1.3 to 3.

3. The ship claimed in claim 1, wherein the mean rake angle of an inboard facade of said longitudinal superstructures is from 15° to 60°.

4. The ship claimed in claim 3, wherein the inboard facade of said longitudinal superstructures comprises terraces.

5. The ship claimed in claim 1, wherein an inboard facade of said longitudinal superstructures comprises terraces.

6. A cruise ship or pleasure boat having classically proportioned quickwork and a main public space bordered by port and starboard longitudinal superstructures which are immovable with respect to the ship and which have an overall transverse inclination which substantially increases the width of the ship above the waterline.

* * * * *